US007475772B2

(12) United States Patent
Cuomo

(10) Patent No.: US 7,475,772 B2
(45) Date of Patent: Jan. 13, 2009

(54) CARRIER AND METHOD

(75) Inventor: Angelo V. Cuomo, Staten Island, NY (US)

(73) Assignee: E-Z Media, Inc., NY, NY (US)

( * ) Notice: Subject to any disclaimer, the term of this patent is extended or adjusted under 35 U.S.C. 154(b) by 503 days.

(21) Appl. No.: 11/301,913

(22) Filed: Dec. 13, 2005

(65) Prior Publication Data

US 2006/0180482 A1 Aug. 17, 2006

Related U.S. Application Data

(63) Continuation-in-part of application No. 11/012,789, filed on Dec. 15, 2004, now Pat. No. 7,370,755, and a continuation-in-part of application No. 11/012,440, filed on Dec. 15, 2004, now Pat. No. 7,383,949, and a continuation-in-part of application No. 10/939,264, filed on Sep. 10, 2004, and a continuation-in-part of application No. 10/737,612, filed on Dec. 16, 2003, now Pat. No. 7,267,224, and a continuation-in-part of application No. 10/662,265, filed on Sep. 15, 2003, now Pat. No. 7,243,785, and a continuation-in-part of application No. 10/215,938, filed on Aug. 9, 2002, now Pat. No. 7,185,758.

(51) Int. Cl.
*B65D 75/00* (2006.01)

(52) U.S. Cl. ..... 206/162; 206/427; 206/549

(58) Field of Classification Search ..... 206/139, 206/162, 167, 170, 175, 180, 187, 188, 197, 206/427, 541, 549; 229/117, 117.14
See application file for complete search history.

(56) References Cited

U.S. PATENT DOCUMENTS 2,011,232 A 8/1935 Parks
2,026,525 A 1/1936 Korte
2,330,699 A 9/1943 Flamm
2,405,517 A 8/1946 Plummer
2,513,079 A 6/1950 Buerger
2,594,376 A 4/1952 Arneson
2,630,264 A 4/1953 Holy
2,676,731 A * 4/1954 Klein ..... 206/183
2,719,665 A * 10/1955 Tharpe et al. ..... 229/117.09
2,728,484 A * 12/1955 Farrington ..... 206/196
2,850,223 A 8/1958 Strauss
3,123,213 A 3/1964 Kulig
3,140,036 A 7/1964 Spery
3,158,286 A 11/1964 Phillips, Jr.
3,198,379 A * 8/1965 Creelman ..... 206/165
3,547,339 A 12/1970 Bruce
3,576,274 A 4/1971 Stramaglis (Continued)

*Primary Examiner*—David T Fidei
(74) *Attorney, Agent, or Firm*—Kramer Levin Naftalis & Frankel LLP; Gregor N. Neff, Esq.

(57) ABSTRACT

A carrier is provided with vertical support panels, each with a receptacle extending outwardly from its lower region. Each receptacle has a top shelf with at least one opening to receive and provide extra support for beverage cups or other items such as ice cream cones, confection cups, etc. The top shelf panel is held in position either by tabs which fit into slots, or by vertical support panels, or by other structures. The carrier is easily convertible to one having only one top shelf, or none, as needed.

14 Claims, 6 Drawing Sheets

U.S. PATENT DOCUMENTS

| | | | | |
|---|---|---|---|---|
| 3,661,417 | A | 5/1972 | Inman | |
| 3,780,906 | A | 12/1973 | Katzenmeyer | |
| 3,958,744 | A | 5/1976 | Herglotz | |
| 4,047,610 | A | 9/1977 | Stout et al. | |
| 4,196,807 | A * | 4/1980 | Brom | 206/427 |
| 4,378,880 | A | 4/1983 | Summers | |
| 4,610,349 | A | 9/1986 | Schwartz et al. | |
| 4,620,664 | A | 11/1986 | Kaufman et al. | |
| 4,767,051 | A | 8/1988 | Single | |
| 4,770,294 | A | 9/1988 | Graser | |
| 4,836,367 | A | 6/1989 | Golkar | |
| 4,969,595 | A | 11/1990 | Teasdale | |
| 5,052,552 | A | 10/1991 | Maroszek | |
| 5,320,216 | A | 6/1994 | Pangborn | |
| 5,337,947 | A | 8/1994 | Eskandry | |
| D367,409 | S | 2/1996 | Hunter | |
| 5,695,051 | A | 12/1997 | Hart | |
| 5,709,298 | A | 1/1998 | Harris | |
| 5,738,217 | A * | 4/1998 | Hunter | 206/549 |
| 5,797,486 | A | 8/1998 | Picciolo | |
| 5,803,264 | A | 9/1998 | Gersten et al. | |
| 5,927,502 | A | 7/1999 | Hunter | |
| 6,202,836 | B1 * | 3/2001 | Picciolo | 206/194 |
| 6,341,689 | B1 | 1/2002 | Jones | |
| 6,443,308 | B1 | 9/2002 | Davis | |
| 2003/0209454 | A1 * | 11/2003 | Hunter | 206/217 |
| 2004/0159577 | A1 * | 8/2004 | Hunter | 206/549 |

* cited by examiner

FIG.1.
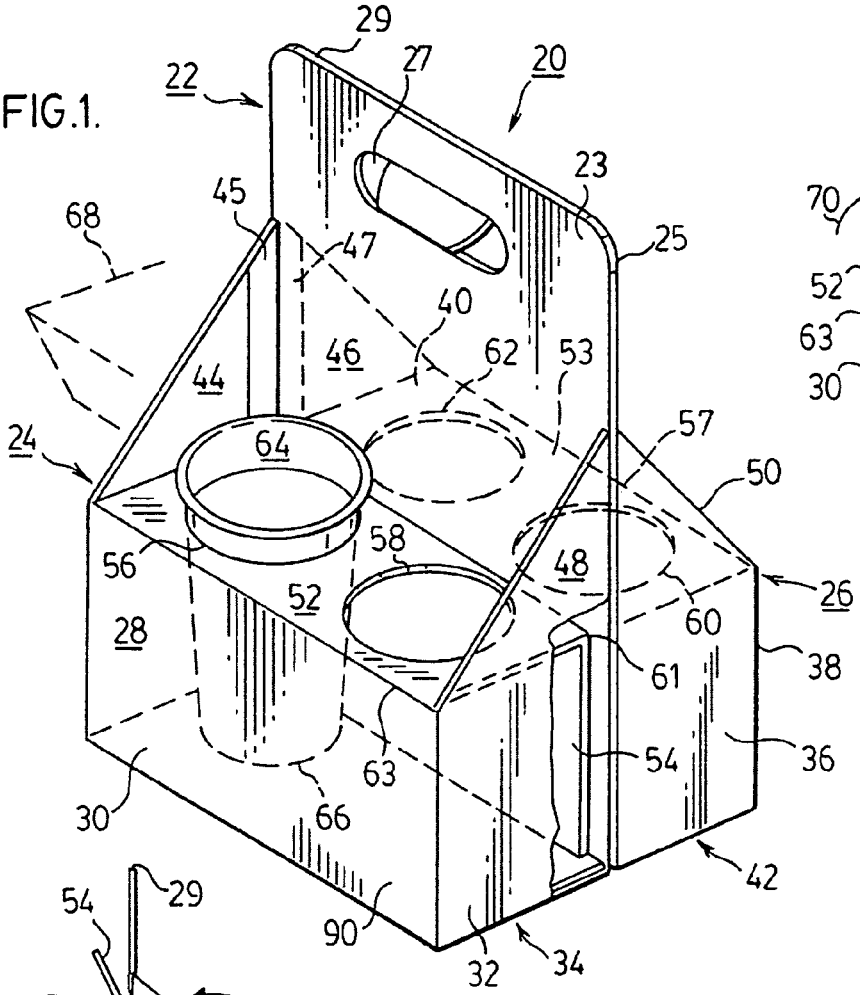
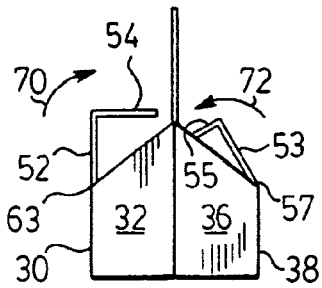
FIG. 2.
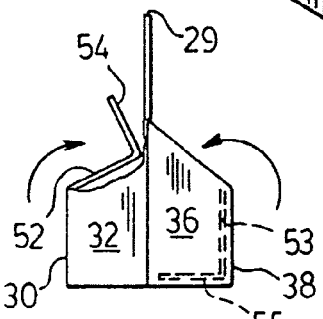
FIG. 2A.
FIG. 4.
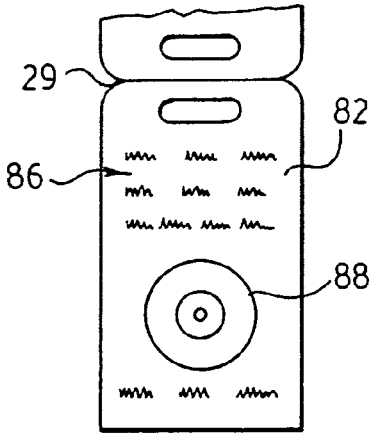
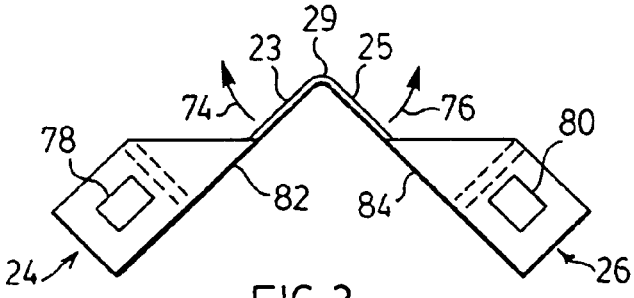
FIG. 3.

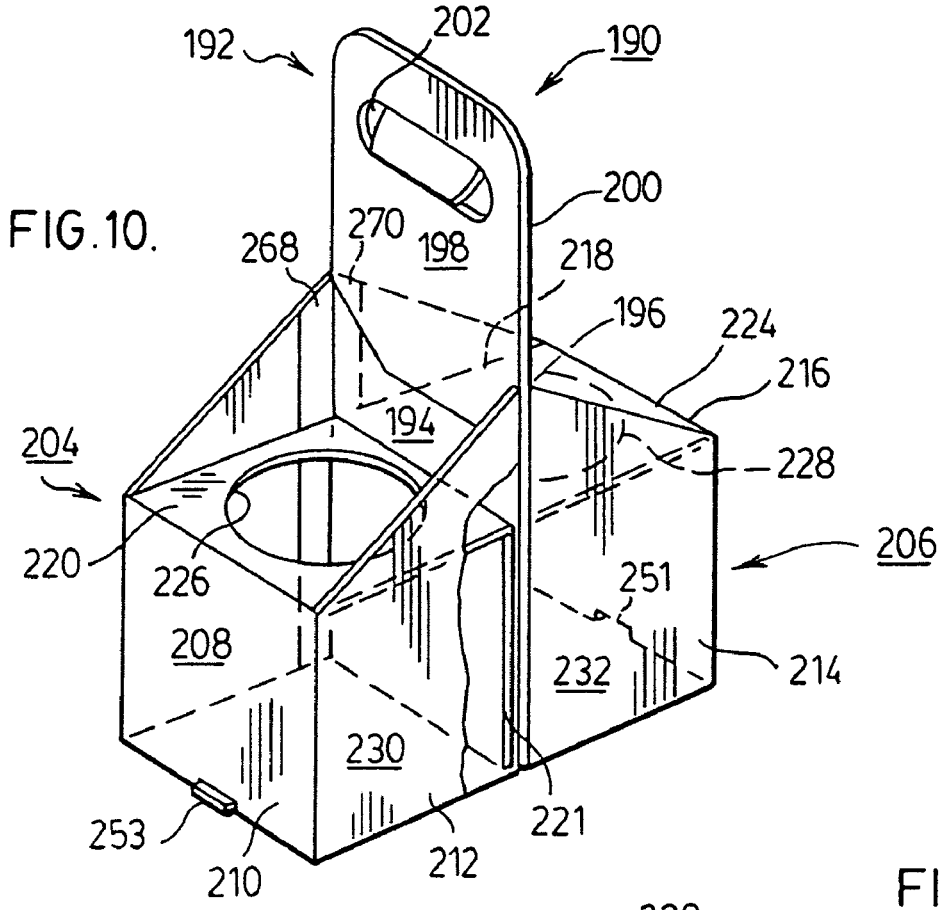
FIG.10.
FIG.12.
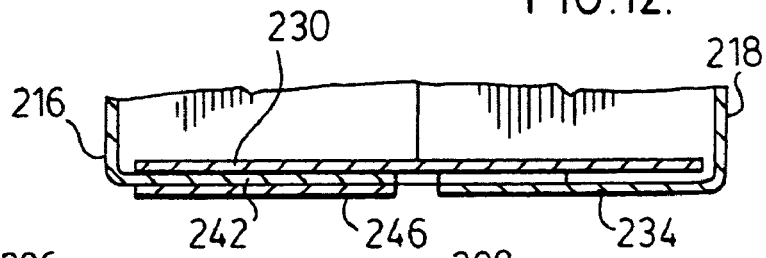
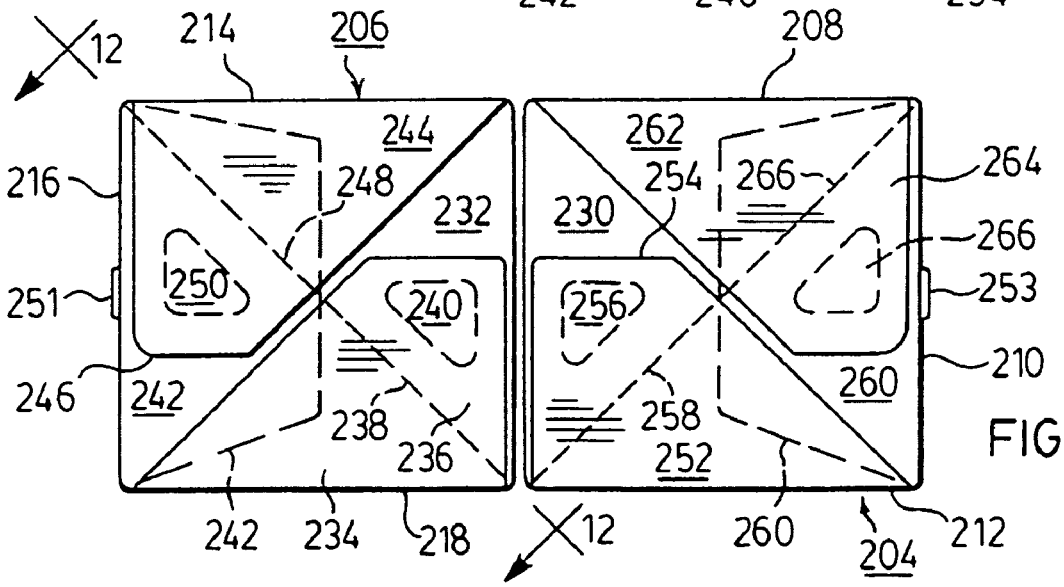
FIG.11.

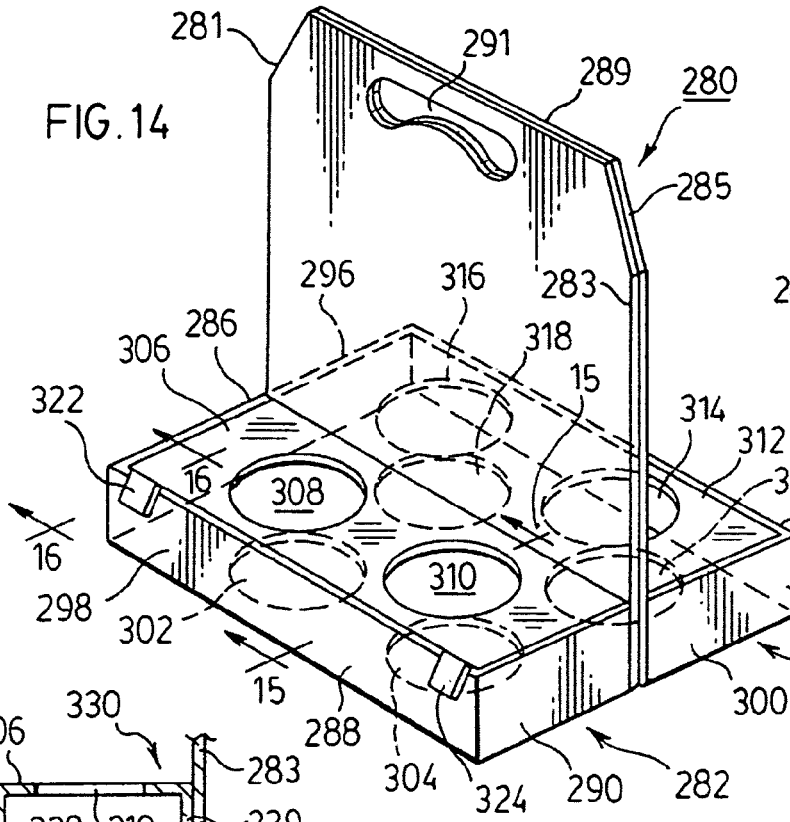
FIG. 14
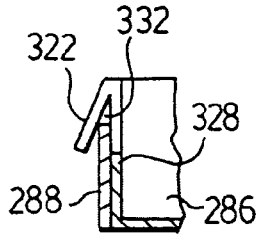
FIG. 16.
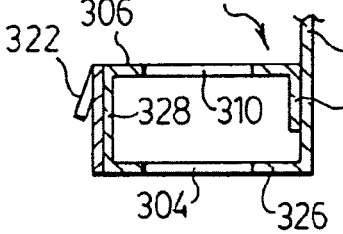
FIG. 15.
FIG. 17.
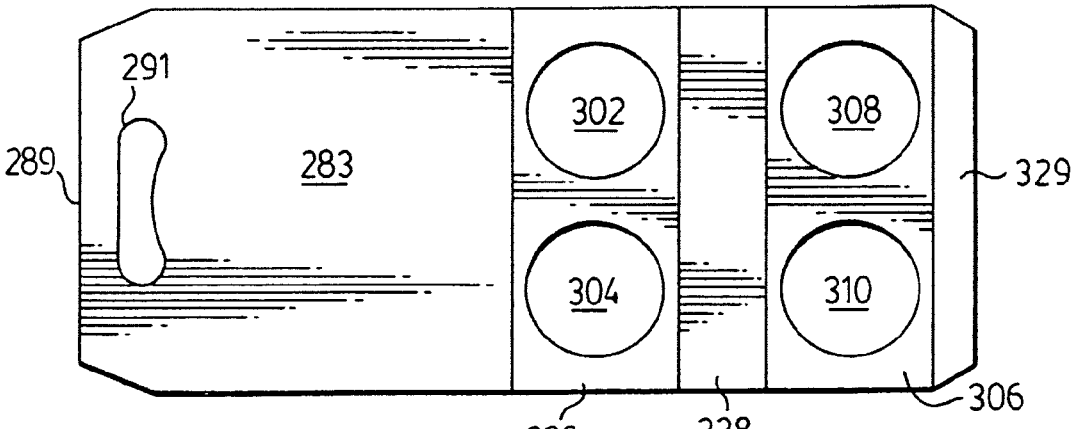
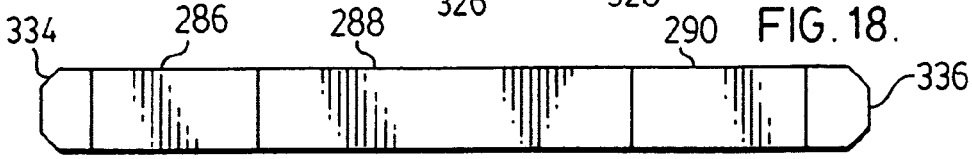
FIG. 18.

CARRIER AND METHOD

This patent application is a continuation-in-part of U.S. patent applications Ser. No. 10/213,938 filed Aug. 9, 2002, Now U.S. Pat. No. 7,185,758; Ser. No. 10/662,265, filed Sep. 15, 2003, now U.S. Pat. No. 7,243,785; Ser. No. 10/737,612 filed on Dec. 16, 2003 now U.S. Pat. No. 7,267,224; Ser. No. 10/939,264 filed on Sep. 10, 2004, Ser. No. 11/012,440 filed on Dec. 15, 2004, now U.S. Pat. No. 7,383,949; and Ser. No. 11/012,789, filed Dec. 15, 2004, now U.S. Pat. No. 7,370,755. The disclosure of those patent and patent applications are hereby incorporated herein by reference.

This invention relates to carriers for beverages, food, liquids in containers and other objects, and to methods of making and using such carriers.

In the above-identified prior patent applications are disclosed a number of different general-purpose carriers, and other carriers which are highly advantageous for use in carrying beverages, e.g., in "six packs" of bottles containing soft drinks, beer, etc. Other carriers are specially adapted for use in carrying both beverage cups and solid foods in sports arenas, fast-food restaurants, etc.

Although those carriers are highly advantageous, it is an object of the invention to improve the support provided for items such as open beverage cups held in the carriers and to minimize spillage of the beverages. This can reduce the chances of scalding buyers of hot coffee, tea, soup, etc., from a take-out food store, and avoid stains and other adverse effects of such spillage.

It also is an object of the invention to provide a carrier for stabilizing and carrying certain odd-shaped items such as ice cream and other frozen confection cones and cups, yogurt cups, etc.

Accordingly, it is an object of the invention to provide a carrier and blank, and a method of making such a carrier, in which objects of the type described above, and similar objects, can be carried with ease, stability and safety.

It is another object of the invention to provide such a carrier which is relatively easy to use, and relatively inexpensive to make.

It is another object to provide such a carrier which is relatively strong and capacious, and relatively easy to unfold, and can be used with relative safety and reliability to carry cumbersome objects with a minimum of spillage.

In accordance with the present invention, the foregoing objects are satisfied by providing a carrier with a vertical support panel structure and two foldable receptacles, each extending outwardly from the lower regions of said vertical support panel structure. A bottom structure unfolds automatically as the carrier blank is unfolded in order to erect the carrier. A top shelf structure provides lateral support for the objects at a location substantially above the bottom structure. This helps keep tall beverage containers from tipping and supports ice cream cones and similar objects for easy carrying.

Preferably, the top shelf structure is formed by at least one extension from a side-wall of each receptacle. Holding means are provided for holding the extension above the bottom of the receptacle.

One type of holding means comprises a further extension which extends down to the bottom structure to support the top shelf extension and keep it parallel to the bottom of the receptacle.

In an alternative embodiment, the top shelf is held in place by a plurality of tabs extending from its side edges and fitted into slots in the carrier side walls and vertical support panels.

Another holding means is a structure which can rest on the top edges of the receptacle, with or without lock tabs and slots.

The foregoing provides a convertible carrier which easily can be converted from one which has a top shelf to one which does not. The conversion is made with one easy motion, namely, merely pushing the top shelf all the way down until it lies against the inside of one of the side walls of the receptacle, where it is out of the way.

Another alternative is to make both the top shelf and the bottom structure from a single folded extension of the vertical support panel.

Each top shelf can have either one or a plurality of object-receiving and supporting openings. Thus, two-cup, four-cup or other carriers can be provided, in a carrier with two receptacles, one extending from each side of said vertical support panel structure.

An auxiliary tray can be fitted over the handle formed by the vertical support panel structure to allow the user to carry even more objects while still using only one hand.

As with some of the carriers shown in the above-identified patent applications, the vertical support panel structure can be made either with two panels fastened together back-to-back, or with the two panels hinged together so that advertising and/or promotional materials can be located on the inside surfaces of the panels, and the panels swung apart to give access to the customer.

The foregoing and other objects and advantages of the invention will be apparent from or set forth in the following description and drawings.

IN THE DRAWINGS:

FIG. 1 is a perspective view, partially broken-away, of one embodiment of a carrier constructed in accordance with the present invention;

FIGS. 2 and 2A are end elevation views of the carrier of FIG. 1;

FIG. 3 is another end elevation view of the carrier of FIG. 1, with the halves of the carrier pivoted apart from one another;

FIG. 4 is a side elevation view of an interior surface of the carrier of FIGS. 1-3;

FIG. 10 is a perspective view of another embodiment of the carrier of the present invention;

FIG. 11 is a bottom plan view of the carrier shown in FIG. 10;

FIG. 12 is a cross-sectional view taken along line 12-12 of FIG. 11;

FIG. 14 is a perspective view of another carrier constructed in accordance with the present invention;

FIG. 15 is a cross-sectional view taken along line 15-15 of FIG. 14;

FIG. 16 is a broken-away cross-sectional view taken along line 16-16 of FIG. 14; and FIGS. 17 and 18 are plan views of parts of the blanks used to construct the carrier of FIGS. 14-16.

FOUR-CUP CARRIER

Figure 5:
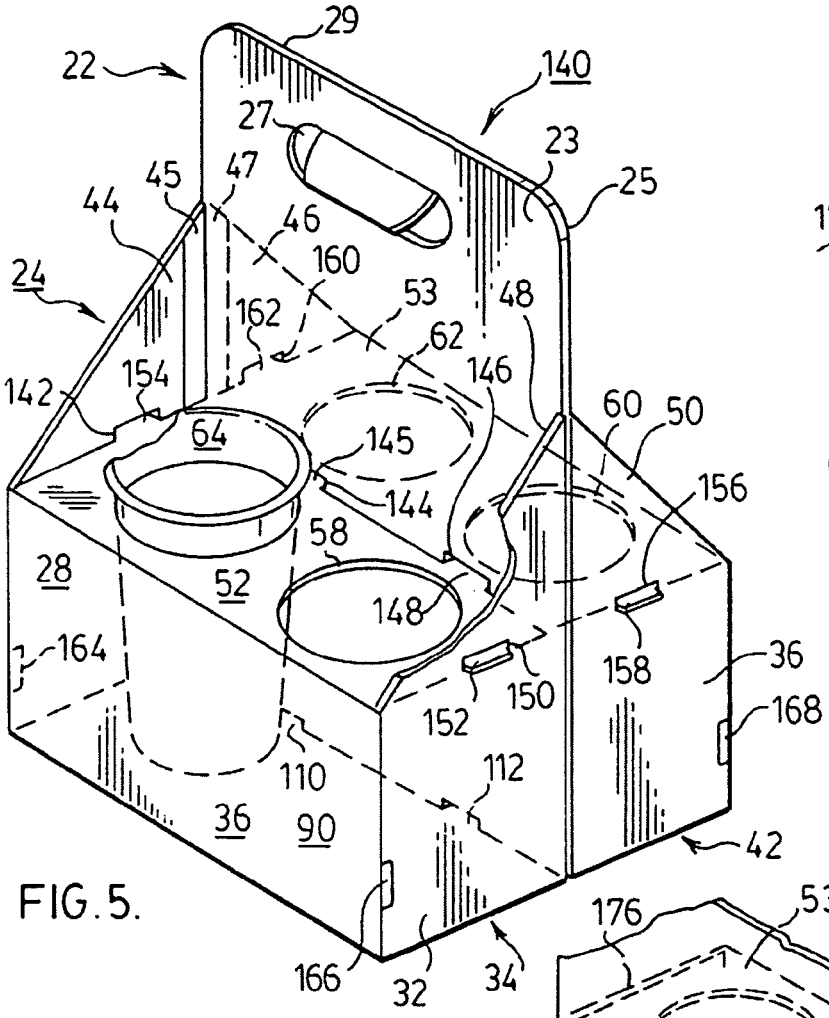
FIG. 5 is a perspective view, partially broken away, of another embodiment of the present invention.

FIGS. 1-4 and 8-9 show a four-cup carrier 20 constructed in accordance with the present invention.

Referring primarily to FIG. 1, the carrier 20 includes a vertical support panel structure 22 with two parallel panels 23 and 25 secured together along the top edge 29 so that the panels are hinged together back-to-back.

A pair of receptacles 24 and 26 is provided, one receptacle extending from the panel 23 and the other extending from the panel 25. The lower portion of the panel 23 forms one side wall of the receptacle 24, and three additional side walls 28, 30 and 32 complete the side wall structure. A bottom panel structure 34 forms the bottom of the receptacle.

Similarly, the receptacle 26 consists of the lower portion of panel 25 as one side wall, and additional side walls 36, 38 and 40, as well as a bottom panel structure 42.

A handle hole 27 is provided in the two panels 23 and 25.

Gussets 44, 46, 48 and 50 are provided to strengthen the carrier structure.

In accordance with the invention, a top shelf 52 or 53 is provided for each of the receptacles 24 and 26. The top shelf 52 is hinged to the upper edge of the long side panel 28, and the top shelf 53 is hinged to the upper edge of the side panel 38.

Each of the top shelves has a pair of beverage cup sized holes 56 and 58, 60 and 62 for receiving beverage cups like the cup 64 fitted into the opening 56.

Figure 9:
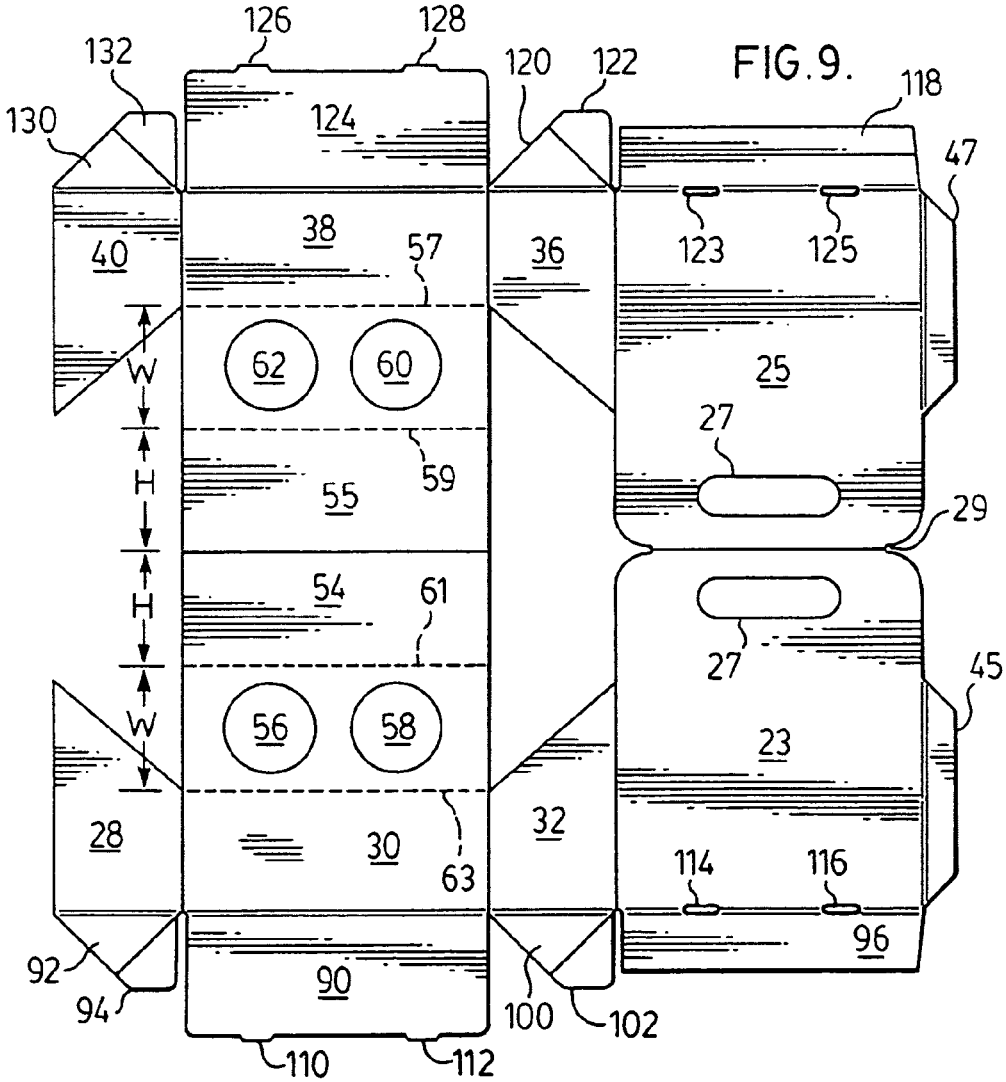
FIG. 9 is a plan view of a blank used to make the carrier of FIG. 1.

Each of the top shelf panels 52 and 53 has an extension 54 or 55 (see FIG. 2) hinged to the top shelf panel at a fold line 61 or 59 (see FIG. 9). The extension extends down to the bottom structure 34 and provides vertical support for the rear or innermost edge of the top shelf 52 or 54.

Preferably, the width W (FIG. 9) of the top shelf panels 52, 53 is approximately equal to the widths of the bottom structures 34 and 32, and the heights H of each extension panel 54, 55 is equal to the height of the side panels 30 and 38, which also is equal to W, the widths of the top shelf panels.

In use, as shown in FIG. 2 of the drawings, after the carrier has been unfolded from its initial folded state, the panels 52 and 54 are bent over and pushed downwardly into the interior of the carrier to the position shown in FIG. 1. The top shelf structure 52 is rotated in the direction of the arrow 70, and the top shelf structure 53 is rotated in the direction of the arrow 72 in FIG. 2.

The top shelves provide a superior carrier for carrying beverage cups and other objects to be described below.

As it is shown in FIG. 1, the beverage cup can be open, without a cover, as is often the case with some beverage stores. The sides of the cup are supported near the top of the cup, whereas the bottom of the cup 66 rests on the top layer 90 of the multi-ply bottom structure 34. Thus, the cup is fully supported by a solid bottom, while the top portion of the cup is supported at the sides so as to minimize the chance of spilling the beverage from the cup. This can be particularly beneficial in preventing burns by customers purchasing hot coffee or other hot beverages.

In addition to carrying beverage cups, the openings in the top shelf are dimensioned to carry other objects such as ice cream cups, ice cream cones, frozen yogurt and other confection cups, etc. The carrier thus is a multi-purpose carrier with side support for ungainly objects.

If desired, a suitably shaped foldable tray 68 can be inserted over the handle 29 with slots to receive the gussets 44, 46, 48 and 50 as shown in dashed outline at 68 in FIG. 1. Such a tray is described in detail in my above-identified prior applications and will not be described in detail here. By the use of the additional tray, additional solid foods can be loaded into the carrier to be carried, together with the beverages, using only one hand.

It should be understood that the carrier 20 shown in FIG. 1 can be constructed by fastening the two parallel vertical support panels 23 and 25 together back-to-back. However, they are shown hinged together at 29 so that the two receptacles 24 and 26 can be swung apart in the manner shown in FIG. 3. The inside surfaces 82 and 84 of the panels 23 and 25 then can be viewed, in the manner shown in FIG. 4. Therefore, advertising material such as that shown at 86, and free CD records, such as the record 88, can be viewed by the customer. The feature illustrated in FIGS. 3 and 4 also is shown in one or more of the above-identified co-pending U.S. patent applications and the further description of those applications hereby is incorporated herein by reference.

Figure 8:
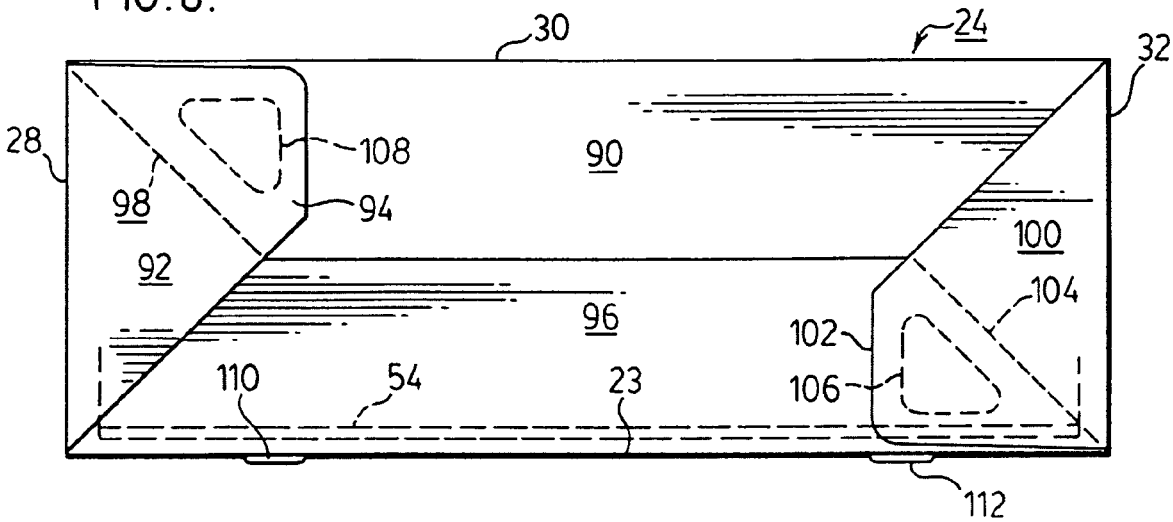
FIG. 8 is a bottom plan view of one of the receptacles of the carrier shown in FIG. 1.

FIG. 8 of the drawings is a bottom plan view of the receptacle 24. The bottom construction is like that shown in the above-identified co-pending patent applications. A flange 90 which extends across the entire bottom of the receptacle is hinged to the lower edge of the side panel 30.

Opposite the panel 30 at the lower edge of the vertical support panel 23 is hinged a flange 96 which extends across a half of the width of the bottom structure, just underneath the panel 90. Flanges 92 and 100 are hinged to the lower edges of the side wall panels 28 and 32, respectively. Each has a tab 94 and 102, extending from the flange 92 or 100 and foldable along a diagonal fold line 98 or 104. Each of the tabs 94 and 102 is glued to a nearby flange. The tab 94 is glued by means of a glue patch 108 to the panel 90. Similarly, the tab 102 is glued by a glue patch 106 to the panel 96.

As it is described in greater detail in the above-identified co-pending patent applications, as the sides of the folded carrier are pressed, the receptacles automatically open and the broad top panel 90 moves partially downwardly to a position where it holds the receptacle open for filling with objects to be carried.

When the panel 90 is pressed all the way down, a pair of tabs 110 and 112 protrude through slots 114 and 116 in the vertical support panel (see FIG. 9) to lock the bottom panel 90 in place.

The bottom structure thus formed is a very strong multi-ply bottom having anywhere from one to three thicknesses of material supporting it.

FIG. 9 shows the blank used to make the carrier 22 shown in FIG. 1.

FIG. 9 shows that the receptacle 26 is formed by a series of panels like those described above for the receptacle 24. The bottom structure 42 is comprised of a broad panel 124 with tabs 126 and 128, two end flanges 130 and 120 with tabs 132 and 122, and a further flange 118 which correspond to the components shown in FIG. 8. The tabs 126 and 128 fit into the holes 123 and 125 when the bottom is completely unfolded.

Glue tabs 47 and 45 are provided to be glued to the wall panels 40 and 28, respectively, to complete each side wall structure, in the manner shown in FIG. 1.

In general, lines marked "FOLD" in FIG. 9 are lines on which the blank is to be folded, and lines not otherwise marked are cut lines where cuts are made. The tabs marked "GLUE" are where glue is to be placed during the manufacturing of the carrier. The "NO COPY" designations indicate areas which are not to be printed. The blanks usually are printed when in the blank form shown in FIG. 9.

Because the panels 23 and 25 are hinged together at the top and are not glued together, they can be printed on both sides, as illustrated in FIGS. 3 and 4.

Alternative Top Shelf Carriers

Figure 6:
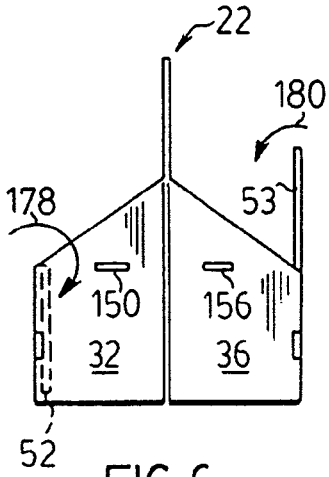
FIG. 6 is an end elevation view of the carrier of FIG. 5.

FIGS. 5 and 6 show another embodiment of the top shelf carrier. It is the same in construction as the carrier 22 shown in FIG. 1, except that vertical support panels 54 and 55 for the top shelves 52 and 53 have been eliminated. Instead, each top shelf 52 and 53 is supported in a horizontal position by a plurality of tabs 154, 144, 148 and 152 extending through slots 142, 144, 146 and 150 in the side walls of the receptacles.

The top shelf 53 has tabs 158 and 162 extending through slots 156 and 160 in the side walls, as well as two additional tabs (not shown) extending through the same holes 144 and 146 used by the tabs 145 and 148.

FIG. 6 shows the manner in which the top shelves are erected. Top shelf 53 is rotated in the direction of arrow 180 until the tabs fit into the slots in the side walls of the receptacle.

Similarly, the top shelf 52 is rotated in the direction 178. In accordance with one advantageous feature of this embodiment of the invention, the top shelf 52 has been rotated all the way to the vertical position up against the inner surface of the side wall 30 where the tabs 152 and 154 in the sides of the top shelf extend through vertical slots 164 and 166. This holds the top shelf panel out of the way.

This arrangement has the advantage that it makes the carrier convertible from one with top shelves to a different form—one with either no top shelves or one top shelf in one receptacle and none in the other.

This can be very advantageous in carrying many different kinds of objects. For example, in a fast food outlet, if a customer orders two hot coffees and two hamburgers, the carrier can be set up by rotating one of the top shelves to the horizontal position and the other to the vertical position as shown in FIG. 6. Thus, hot beverages can be put in the receptacle with the top shelf, and the hamburgers in the other receptacle, where there is more room to hold the hamburgers.

A further advantage of the embodiment shown in FIGS. 5 and 6 is that it is easy and quick for the worker to set up the carrier, and it requires less material.

Figure 7:
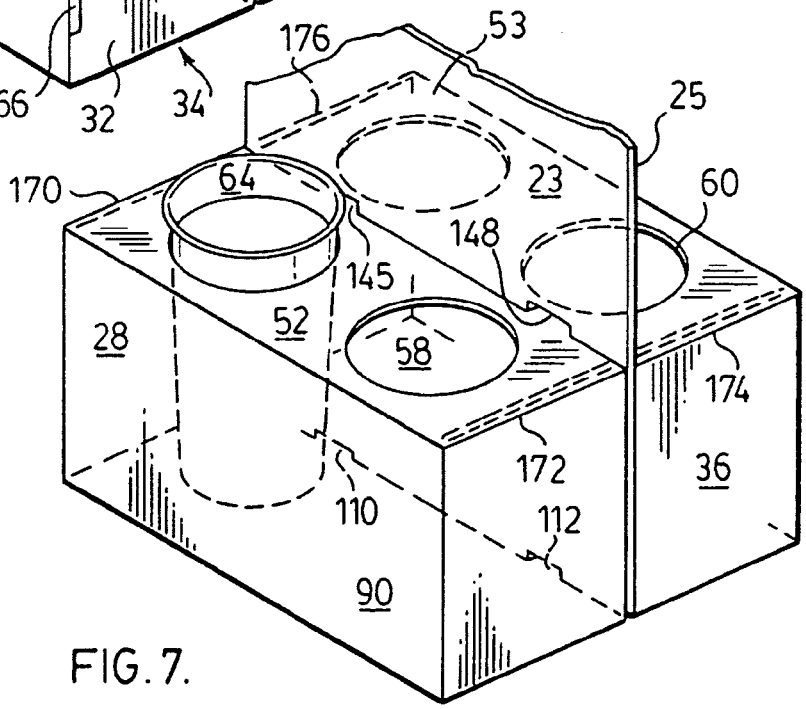
FIG. 7 is a perspective, partially broken-away view of another embodiment of the carrier of the present invention.

FIG. 7 shows another alternative embodiment in which the carrier has no gussets. This structure is like the one in FIGS. 5 and 6, except that the edges 170, 172, 174 and 176 of the top shelves 52 and 53 extend somewhat beyond the upper edges of the receptacle walls so that the top shelf panels rest on the upper edges of the walls. This is essentially the same as the embodiment shown in the above-identified patent application Ser. No. 11/012,440, filed Dec. 15, 2004. Tabs 145 and 148 also are provided as in the embodiment shown in FIGS. 5 and 6, to support the innermost edge of the top shelf panel.

The embodiment in FIG. 7 also can be converted from a top shelf carrier to one without top shelves by pressing the top shelf structures all the way to the vertical position. The material at the edges 170, 172, etc., bends sufficiently to permit this motion.

FIG. 2A shows that the carrier 20 of FIG. 1 also is convertible. Instead of folding the extension 54 or 55 downwardly, as shown in FIG. 2, one folds the extensions upwardly along the fold line 59 or 61 (FIG. 9) and pushes the top shelf panels down into the receptacles, in the directions indicated by the arrows in FIG. 2A. This causes the extensions 54, 55 to lie flat on the bottom of the receptacles and the top shelf panels 52, 53 to stand vertically against the inside surface of side wall 30 or 38. Because the widths of the top shelf panels is equal to the width of the receptacle bottoms, the folded-down panels will be fitted into the receptacles snugly and stay there while objects are being carried.

In fact, the extension 54 or 55 adds another layer to the multi-layer bottom and further strengthens it. This can increase the effective capacity of the carrier for carrying relatively heavy and wet objects.

The convertible capability of the carriers also can be useful when the holes 56, 58, 60, 62 are too small to admit very large beverage cups. One merely swings the top shelves out of the way, and the large size of the cups tends to cause them to lean against one another for lateral support.

Two-Cup Carrier

FIGS. 10-13 show a two-cup carrier version of the invention. The construction is substantially the same as that shown in FIG. 1 except that it is half as wide and therefore has only two cup-holding receptacles instead of four.

Figure 13:
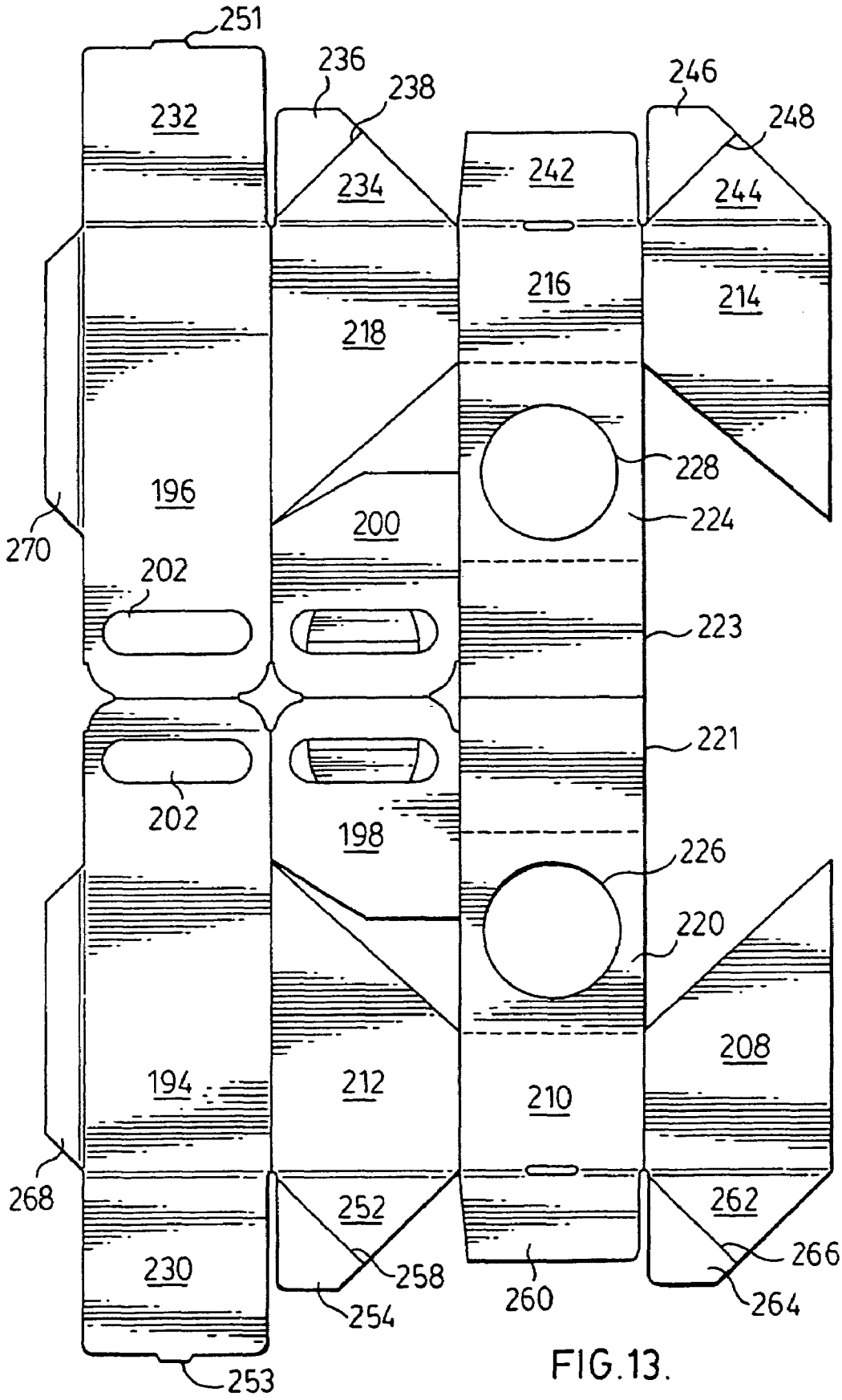
FIG. 13 is a plan view of a blank used to make the carrier shown in FIGS. 10-12.

Two top shelf panels 220 and 224 are provided, each having a cup receiving opening 226 or 228, and a vertical support panel 221 or 223 (see FIG. 13).

As with the embodiment shown in FIG. 1, the carrier 190 has a vertical support panel structure 192 with back-to-back vertical support panels 194 and 196, with overlays 198 and 200 in the upper portion to thicken and strengthen the handle structure in the upper portion.

FIG. 11 is a bottom plan view of the carrier shown in FIG. 10. The receptacle 206 has flanges 244 and 234 extending from the side walls and panel 242 extending from the outside wall 216. The flanges 234 and 244 have tabs 236 and 246, respectively, which are glued at 240 and 250 to the panels 232 and 242, respectively. The tabs and flanges are foldable along diagonal lines 248 and 238.

Similarly, the side walls 208 and 212 have flanges 262 and 252 extending from them, with tabs 254 and 264 and glue spots 256 and 266 where they are glued to the panels 230 and 260, respectively.

FIG. 12 is a cross-section taken along line 12-12 of FIG. 11, showing the multi-ply bottom in cross-section. It can be seen that the top panel 230 extends across virtually the whole surface of the bottom and the various flanges form a triple thickness bottom in some places and a double thickness bottom in other places, thus amply demonstrating the strength of the bottom structure of the carrier.

The blank of FIG. 13 is folded along "FOLD" lines, glued where it is marked to be glued, and cut along other lines and assembled, much in the manner of the other carrier described above, with the flanges 268 and 270 being glued respectively to the inside edge of side walls 208 and 214 as shown in FIG. 10 as well as FIG. 13. The other legends in FIG. 13 have the same meaning as they do in FIG. 9.

Alternative Four-Cup Carrier

FIG. 14 shows an alternative embodiment 280 of the carrier of the present invention. This embodiment is one shown originally in patent application Ser. No. 10/215,938 filed on Aug. 9, 2002 now U.S. Pat. No. 7,185,758. The carrier 280 has a vertical support panel structure 281 with a front panel 283 and a rear panel 285. The upper edges of the two panels are shown at 289, and a hand hole 291 is provided near the upper edge 289. The panels are secured together, as with adhesive, but also can be hinged at the top in the manner of the embodiment shown in FIG. 1.

The carrier has two receptacles 282 and 284 extending outwardly from the lower portion of the vertical support panel structure 281. Each has a three-wall enclosure. The receptacle 282 has an enclosure formed by wall 286, 288 and 290 which are secured together along fold lines and are attached to the panel 283.

Similarly, the receptacle 284 has three panels 292, 294 and 296 which form an enclosure as shown when folded. It should be understood that both of these structures fold flat for shipping and are unfolded for erection of the carrier.

As it is shown in FIGS. 15 and 17, as well as in FIG. 1, the lower edge of the vertical support panel 283 has an extension structure which includes a first panel 326 which has the same width as the inside of the enclosure formed by panels 286, 288 and 290, a vertical panel 328 which has the same height as the wall 288, and a panel 306 hinged along the fold line to the panel 328. Panel 306 also is as wide as the interior of the enclosure and a tab 329 extends from the right edge of the panel 306.

As FIG. 15 shows, the panels 326, 328 and 306 are folded in the manner shown to form a rectangular tube-like structure which is inserted into the enclosure and is supported by a pair of tabs 322 and 324 which hang over the top edge of the panel 388 to support the tubular structure within the enclosure and support beverage cups mounted in the holes 308 and 310 and 302 and 324 in the panels 326 and 306. The tabs 322 and 324 are formed from the material of the vertical portion 328, although this is not shown in FIG. 17.

FIG. 18 shows the blank forming the enclosure consisting of side walls 286, 288 and 290. Tabs 334 and 336 are adhesively secured to the inside surface of the panel 283.

The receptacle 284 on the other side of the carrier has a construction conforming to that shown in FIGS. 17 and 18. Thus, there is a top shelf panel 312 with holes 314 and 316 and a bottom panel 300 with holes 318 and 320 aligned with the holes 314 and 316. Tabs like tabs 322 and 324 are provided also to hold the structure within the enclosure on the right side of the carrier. The structure fitted into the enclosure is secured to the panel 283 by means of adhesive applied to the tab 329.

Further details of the construction of the carrier 280 are described in the above-identified U.S. patent application and will not be repeated here.

FIG. 16 shows that notches 332 are cut in the upper edge of the side panels 288 and 294 just underneath the position of the tabs 322 and 324.

In the carrier shown in FIGS. 14 through 18, beverage cups extend through both openings in the top and those below. Of course, this structure can be made taller with a solid bottom, if desired.

Materials

The materials of which the carrier of the present invention can be made need not be expensive. Ordinary, medium-weight fiberboard is believed to be sufficient for most purposes. For example, it can be 0.20 S.U.S. recycled newspaper material. If waterproofing beyond the acrylic coating provided on such board is necessary, a further waterproof coating can be applied on both the inside and outside surfaces.

It is within the realm of the invention also to make the carriers out of flexible plastic materials.

If desired, the carriers can be made of plastic materials that are easily washable so that the carriers can be reused.

Bonding of parts to one another can be done by means other than adhesives. For example, plastic or plastic coated parts can be bonded together by ultrasonic or heat bonding. Staples or other mechanical fasteners also can be used.

The above description of the invention is intended to be illustrative and not limiting. Various changes or modifications in the embodiments described may occur to those skilled in the art. These can be made without departing from the spirit or scope of the invention.

What is claimed is:

1. A carrier having a vertical support panel structure, at least one foldable receptacle with vertical side wall panels foldably secured to said vertical support panel structure, said side wall panels being foldable and unfoldable along vertical fold lines, a bottom structure having bottom panels foldably extending from the lower edges of said vertical side panels and interconnected with one another to form a horizontal support structure when said receptacle is unfolded, a foldable top shelf structure for said receptacle, said top shelf structure comprising a shelf panel extending from the upper edge of one of said vertical side panels and dimensioned to fit into said receptacle and having an engagement structure for engaging one or more panels of said carrier to hold said shelf panel at an upper position spaced vertically upwardly from said bottom structure, in which said vertical support panel structure includes a pair of vertical support panels secured together, each panel having an upper portion and a lower portion, said foldable receptacle being secured in said lower portion to one of said vertical support panels, a second receptacle with the same structural features as the first-named receptacle and secured to said lower potion of the other of said vertical support panels.

2. A carrier as in claim 1 in which said top shelf panel has at least one opening dimensioned to receive a container, or a frozen confection cone or another tapered object therein.

3. A carrier as having a vertical support panel structure, at least one foldable receptacle with vertical side wall panels foldably secured to said vertical support panel structure, said side wall panels being foldable and unfoldable along vertical fold lines, a bottom structure having bottom panels foldably extending from the lower edges of said vertical side panels and interconnected with one another to form a horizontal support structure when said receptacle is unfolded, a foldable top shelf structure for said receptacle, said top shelf structure comprising a shelf panel extending from the upper edge of one of said vertical side panels and dimensioned to fit into said receptacle and having an engagement structure for engaging one or more panels of said carrier to hold said shelf panel at an upper position spaced vertically upwardly from said bottom structure, in which said engagement structure comprises a foldable extension from one end of said shelf panel, said extension being dimensioned to extend down to said bottom structure of said receptacle and support said foldable top shelf panel in a horizontal position when said top shelf panel is folded over and said extension is inserted downwardly into said receptacle.

4. A carrier having a vertical support panel structure, at least one foldable receptacle with vertical side wall panels foldably secured to said vertical support panel structure, said side wall panels being foldable and unfoldable along vertical fold lines, a bottom structure having bottom panels foldably extending from the lower edges of said vertical side panels and interconnected with one another to form a horizontal support structure when said receptacle is unfolded, a foldable top shelf structure for said receptacle, said top shelf structure comprising a shelf panel extending from the upper edge of one of said vertical side panels and dimensioned to fit into said receptacle and having an engagement structure for engaging one or more panels of said carrier to hold said shelf panel at an upper position spaced vertically upwardly from said bottom structure, in which said engagement structure comprises at least one tab extending from an edge of said top shelf panel, and a slot in at least one of said side wall panels and positioned to receive said tab and hold said top shelf panel in said upper position.

5. A Carrier as in claim 1 in which said upper portion of each of said vertical support panels has a hand hole, said hand holes being aligned with one another, said upper portions extending above said top shelf panel and extending through a slot in the bottom of a slotted container for containing items to be carried.

6. A carrier as in claim 1 in which said bottom structure is solid to support the bottom of a container or other object extending through said opening and is formed by flanges each hinged to the bottom edge of each of one of said vertical side walls and said vertical support panel structure, said flanges being interconnected together to unfold to form said bottom structure.

7. A carrier as in claim 6 in which said receptacle has four of said side walls, one of said side walls being one surface of said vertical support panel structure, and there are four of said flanges, each of said flanges being secured to an adjacent flange with a diagonal fold line to facilitate unfolding of said flanges and the forming of said bottom structure.

8. A carrier having a vertical support panel structure, at least one foldable receptacle with vertical side wall panels foldably secured to said vertical support panel structure, said side wall panels being foldable and unfoldable along vertical fold lines, a bottom structure having bottom panels foldably extending from the lower edges of said vertical side panels and interconnected with one another to form a horizontal support structure when said receptacle is unfolded, a foldable top shelf structure for said receptacle, said top shelf structure comprising a shelf panel extending from the upper edge of one of said vertical side panels and dimensioned to fit into said receptacle and having an engagement structure for engaging one or more panels of said carrier to hold said shelf panel at an upper position spaced vertically upwardly from said bottom structure, in which said engagement structure includes at least one tab extending from one edge of said top shelf panel, and at least one slot in said vertical support panel structure to receive said tab, said top shelf panel having edges which overlap and rest on the top edges of said side walls panels.

9. A carrier unfoldable from a flattened form to erect it to form a carrier, said carrier comprising a vertical support panel structure, a receptacle comprising a receptacle side wall structure comprising a plurality of side wall panels foldably secured to one another and to said vertical support panel structure, and forming an enclosure extending outwardly from said vertical support panel structure when said carrier is unfolded, a foldable bottom structure unfoldable to form a bottom surface for said enclosure, and a foldable top shelf structure unfold able to form a top shelf in said enclosure spaced upwardly from said bottom surface, said top shelf having at least one opening for receiving and holding an object in said carrier, in which said top shelf structure includes a top shelf panel foldably attached to the top edge of one of said side wall panels and a foldable extension from one edge of said top shelf panel, said extension being dimensioned to extend down to said bottom structure to support said top shelf panel.

10. A carrier as in claim 9 in which each of said vertical support panels has a plurality of edges and is hinged to the other of said vertical support panels along one of said edges whereby said panels can be pivoted to separate them to give access to the respective back surfaces of said vertical support panels.

11. A carrier unfoldable from a flattened form to erect it to form a carrier, said carrier comprising a vertical support panel structure, a receptacle comprising a receptacle side wall structure comprising a plurality of side wall panels foldably secured to one another and to said vertical support panel structure, and forming an enclosure extending outwardly from said vertical support panel structure when said carrier is unfolded, a foldable bottom structure unfoldable to form a bottom surface for said enclosure, and a foldable top shelf structure unfold able to form a top shelf in said enclosure spaced upwardly from said bottom surface, said top shelf having at least one opening for receiving and holding an object in said carrier, in which said top shelf structure includes a top shelf panel foldably attached to an upper edge of one of said side wall panels and having an engagement structure for holding said shelf panel horizontal, in which said top shelf panel has at least one tab and said vertical support panel structure has a mating slot, said slot being positioned to receive said tab to hold said shelf panel up.

12. A carrier unfoldable from a flattened form to erect it to form a carrier, said carrier comprising a vertical support panel structure, a receptacle comprising a receptacle side wall structure comprising a plurality of side wall panels foldably secured to one another and to said vertical support panel structure, and forming an enclosure extending outwardly from said vertical support panel structure when said carrier is unfolded, a foldable bottom structure unfoldable to form a bottom surface for said enclosure, and a foldable top shelf structure unfold able to form a top shelf in said enclosure spaced upwardly from said bottom surface, said top shelf having at least one opening for receiving and holding an object in said carrier, in which each of said side wall panels and said vertical support panel structure has an upper edge and a lower edge, and said bottom structure and said shelf are formed by at least three panels foldably secured together and extending from said lower edge of said vertical support panel structure, the first of said three panels being foldable to form said bottom structure, the second forming said shelf, and the third linking said first and second panels together, and fastening means for holding said three panels into said side wall panels.

13. A convertible carrier, comprising a vertical support panel structure, a pair of receptacles extending outwardly from said vertical support panel structure when said carrier is unfolded, a bottom structure forming a solid bottom for each of said receptacles, said receptacles having vertical side walls including one generally parallel to said vertical support panel structure, a top shelf panel hinged and extending from the upper edge of said one vertical wall panel in each receptacle, a securing structure in each receptacle for holding said top shelf panel horizontal above the bottom structure of said receptacle, each of said top shelf panels being movable to a substantially vertical position in said receptacle to convert said receptacle from one having a top shelf to one having none in which said securing structure includes at least one tab extending out from one edge of said top shelf panel and at least one slot in said vertical support panel structure to receive said tab, said tab being sufficiently flexible to bend easily under hand pressure to by pass said slot to free said top shelf panel to move to said vertical position.

14. A convertible carrier, comprising a vertical support panel structure, a pair of receptacles extending outwardly from said vertical support panel structure when said carrier is unfolded, a bottom structure forming a solid bottom for each of said receptacles, said receptacles having vertical side walls including one generally parallel to said vertical support panel structure, a top shelf panel hinged and extending from the upper edge of said one vertical wall panel in each receptacle, a securing structure in each receptacle for holding said top shelf panel horizontal above the bottom structure of said receptacle, each of said top shelf panels being movable to a substantially vertical position in said receptacle to convert said receptacle from one having a top shelf to one having none, in which said securing structure comprises an extension from said top shelf panel which is foldable downwardly to engage said bottom structure to prop said top shelf panel up, and is foldable upwardly to allow said top shelf and said extension to be folded into said receptacle with said extension on said bottom structure and said top shelf against the inside surface of one of said vertical side walls.

* * * * *